US005992377A

United States Patent [19]

Dall'Osso et al.

[11] Patent Number: 5,992,377

[45] Date of Patent: Nov. 30, 1999

[54] MOTORIZED THROTTLE BODY

[75] Inventors: Carlo Dall'Osso, Zola Predosa; Luca Mancini, Bologna; Giuseppe Toniato, Padua, all of Italy

[73] Assignee: Magneti Marelli S.P.A., Milan, Italy

[21] Appl. No.: 08/979,937

[22] Filed: Nov. 26, 1997

[30] Foreign Application Priority Data

Dec. 2, 1996 [IT] Italy ..... B096A0619

[51] Int. Cl.[6] ..... F02D 9/10

[52] U.S. Cl. ..... 123/337; 123/396

[58] Field of Search ..... 123/339.15, 336, 123/337, 361, 396, 397, 399

[56] References Cited

U.S. PATENT DOCUMENTS 5,429,090 7/1995 Kotchi et al. ..... 123/396

5,752,484 5/1998 Apel et al. ..... 123/396

FOREIGN PATENT DOCUMENTS

| | | |
|---|---|---|
| 0 109 792 | 5/1984 | European Pat. Off. . |
| 0 466 227 | 1/1992 | European Pat. Off. . |
| 2 575 518 | 7/1986 | France . |
| 38 00 087 | 7/1989 | Germany . |
| 44 21 013 | 1/1995 | Germany . |

*Primary Examiner*—Tony M. Argenbright
*Attorney, Agent, or Firm*—Oliff & Berridge, PLC

[57] ABSTRACT

Throttle body in which on the internal wall of the feed pipe there is provided at least one channel the base of which defines together with external edge of the butterfly valve at least one limp-home flow and in which on the internal wall of the feed pipe there is provided a curvilinear section, adjacent to the channel, the base of which defines together with the external edge of the butterfly valve at least one idling flow.

4 Claims, 3 Drawing Sheets

MOTORIZED THROTTLE BODY

BACKGROUND OF THE INVENTION

The invention relates to a motorized throttle body, particularly a throttle body suitable for being inserted along an intake manifold of an internal combustion engine, to which the discussion which follows will make explicit reference without thereby losing generality.

Motorized throttle bodies are currently known which comprise a feed pipe, through which a comburent fluid (air), or a comburent fluid/fuel mixture reaches the engine's intake manifold; a butterfly valve housed in a movable manner inside the feed pipe and suitable for choking the flow of comburent fluid as a function of its position; and an operating device suitable for selectively moving the butterfly valve to control the flow of the comburent fluid.

FIG. 1 shows the flow curve of a throttle body which uses a complex kinematic mechanism which is required to achieve the equilibrium position at point LH, which defines the state in which the actuator used to move the butterfly valve malfunctions or is not supplied at all because of a breakdown in the current supply unit (limp-home state). In FIG. 1 the angle $\alpha_{mn}$, which defines the angle at which there is the minimum flow $Q_{mn}$, is close to the minimum angle achievable by the butterfly, whilst the angle $\alpha_{lh}$, which denotes the limp-home angle, is positive and greater than the preceding angle. The system proposed to control the angular movement of the butterfly valve is rather complex to operate in that the characteristics of the springs used have a discontinuity around the angle $\alpha_{lh}$.

FIG. 2 shows the curve of operation of a negative limp-home system. In this case the minimum flow $Q_{mn}$ corresponds to zero ($\alpha_{mn}$=0) whilst in general the opening of the butterfly valve itay range from −90° and +90°. Although there are undoubted advanstages of simplicity, with this system it is, however, extremely critical to guarantee that the flow at the low point is situated at a very precise value defined by specification; contact between butterfly valve and pipe in correspondence with the angle $\alpha$=0° is also possible if the butterfly valve has not been fitted correctly.

From the above it will be clear that even though the system works with the flow curves shown in FIG. 1 or FIG. 2, it is difficult to operate and involves considerable complications in the electronic devices used to control it.

SUMMARY OF THE INVENTION

The object of the invention is to remedy the above-mentioned disadvantages in a simple and effective manner.

The invention provides a motorized throttle body suitable for being fitted along an intake manifold of an internal combustion engine; this throttle body comprising a feed pipe, a butterfly valve housed in movable manner inside the feed pipe so as to define between its internal wall and the external edge of the butterfly valve a plurality of states of supply of a comburent fluid or of a comburent fluid/fuel mixture; this throttle body further comprising an operating device suitable for selectively moving the butterfly valve; throttle body characterized in that on the internal wall of the pipe there is provided a channel the base of which defines together with the external edge of the butterfly valve a limp-home flow ($Q_{lh}$) and further characterized in that on the internal wall of the pipe there is provided a curvilinear section, adjacent to the channel, the base of which defines together with the external edge of the butterfly valve an idling flow ($Q_{mn}$).

BRIEF DESCRIPTION OF THE DRAWINGS

The invention will now be described with reference to the accompanying drawings in which.

DETAILED DESCRIPTION OF THE INVENTION

Figure 4:
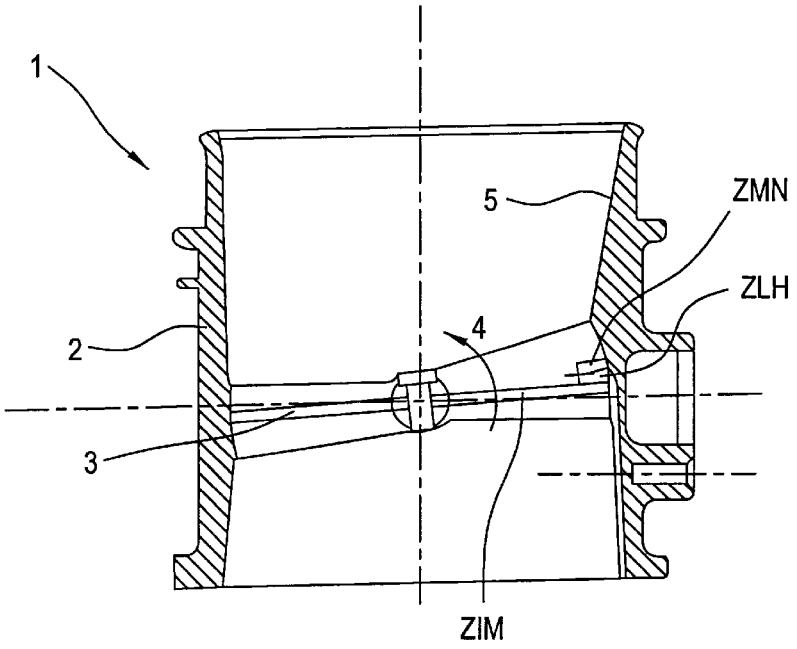
FIG. 4 is a sectional view of a motorized throttle body produced according to the invention.
Figure 5:
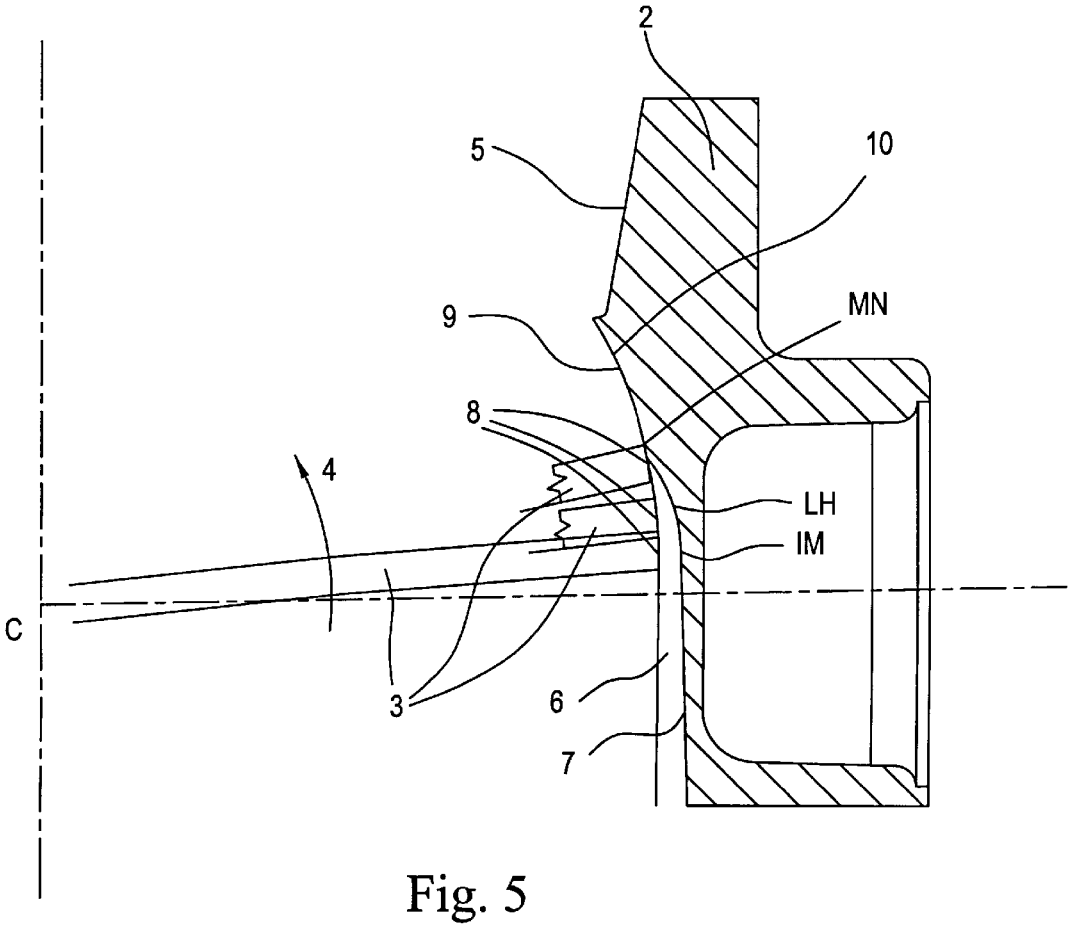
FIG. 5 shows an enlarged detail of the throttle body shown in FIG. 4.

With reference to FIGS. 4, 5, in its entirety 1 denotes a motorized throttle body preferably suitable for being inserted along an intake manifold (not shown) of an internal combustion engine (not shown).

The throttle body 1 comprises a feed pipe 2 inside which there flows, in the example shown, a comburent fluid or a comburent fluid/fuel mixture, which passes through the said intake manifold (not shown) of the internal combustion engine; a butterfly valve 3, housed in movable manner inside the pipe 2 and suitable for choking the flow of the comburent fluid as a function of its angular position inside the said pipe 2; and an operating device (not shown in the accompanying drawings) suitable for selectively moving the butterfly valve 3 to control the flow of fluid. In its turn the operating device is controlled by a control unit which is also not shown.

It should be said incidentally that in FIG. 4, the anti-clockwise direction defined by the arrow 4 has been considered as the positive direction of rotation of the butterfly valve 3; the various elements and positions will therefore be defined, one with respect to the other, by the order in which they are located with respect to this direction of rotation.

In FIGS. 4 and 5 the extension of the central line of symmetry of the butterfly valve 3 meets, in particular, the wall 5 of the feed pipe 2 at:

- a point IM, defined as the point of impact of the valve 3 at which there is the impacting of the valve 3 in the pipe 2; in other words it is at point IM that there is contact between the valve 3 and the pipe 2;
- a point LH, defined as the limp-home point, for which a flow is assured such as to permit the operation of the engine even in the event of breakdown or lack of supply to the actuator which acts on the valve 3; and
- a point MN, such as to permit a minimum flow of supply to the engine.

FIG. 5 shows a channel 6, the base 7 of which defines together with the circular external edge 8 of the butterfly valve 3 a flow $Q_{lh}$ such as to permit the running of the motor vehicle even if there is no supply to or poor operation of the operating device of the butterfly valve 3.

The butterfly valve 3 is adjusted from point IM to point LH by means of an adjusting screw not shown in the accompanying drawings.

The LH position of the butterfly valve 3 in the limp-home position, which defines the limp-home flow $Q_{lh}$ as has been said, must comply with two conditions at the same time:

(A) the relative angle between the LH position and the IM position must be such as to prevent impacts during the operation of the device 1;

(B) the flow $Q_{lh}$ at the LH point (or position) must comply with a very accurate value (limp-home value) defined by the specification which is usually dependent on the requirements of the internal combustion engine.

A suitable dimensioning of the channel 6 enables the position of the LH point to be defined so that the above-mentioned conditions A and B are met.

It should be understood that even though only one channel 6 is shown in the accompanying drawings, the arguments put forward in this description apply to any number of channels 6.

The optimum values for the dimensions of the channel 6 found by the Applicant will be defined in greater detail below.

The channel 6 may be obtained directly by moulding or with specific working on a machine tool.

If the butterfly valve 3 is not controlled because the actuator used to move it is not operating, this butterfly valve 3 is placed in the LH position by a return spring which is not shown in the accompanying drawings.

When the engine is to operate in normal conditions, however, the actuator suitable for moving the valve 3 will position it in the desired positions, all above the MN conditions, and it will be operated if the engine is to idle.

The section above the MN point will have a form suitable for producing, together with the external edge of the butterfly valve 3, a curve of flow as a function of the angle defined by the specification and dependent on the engine's requirements.

The MN position must comply with the following condition:

(C) the flow of the comburent air or of the mixture in correspondence with it must comply with an established value (blow-by flow) defined by the specification of the device and usually dependent on the dimensions of the feed pipe 2.

Figure 3:
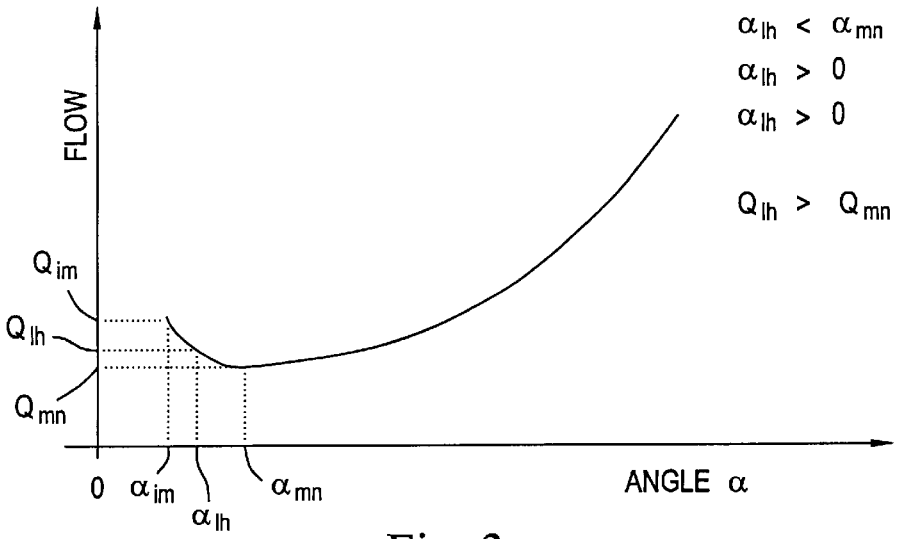
FIG. 3 shows the flow curve as a function of the angle of opening of the butterfly valve for a throttle body according to the invention.

It is easy to check from a study of FIG. 3 that the value of the flow Qlh when the butterfly valve 3 is at point LH is greater than that, $Q_{mn}$, which there is when the said butterfly valve 3 is at the point MN corresponding to the case of engine idling. In other words, this means that the flow of comburent air $Q_{lh}$ for the limp-home situation is greater than that which there is when the internal combustion engine supplied by the pipe 2 is idling ($Q_{mn}$).

The form of the section 9 will be chosen on the basis of the desired specifications of flow $Q_{mn}$.

Figure 6:
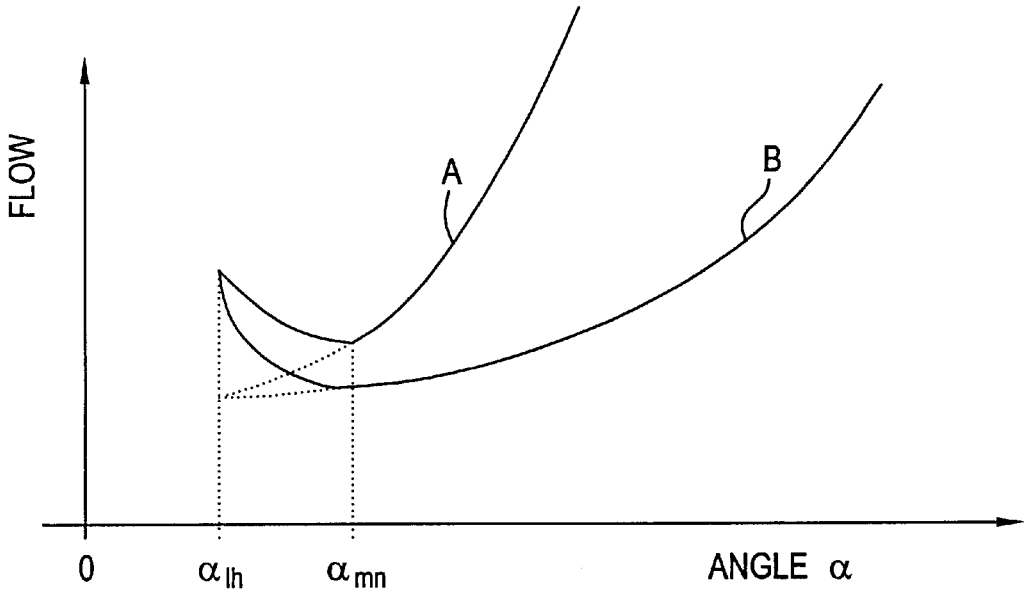
FIG. 6 shows the flow curves corresponding to some forms of the feed channel.

To obtain low values of $Q_{mn}$, this profile must be of curvilinear form. Reference should be made to FIG. 6 in this connection, which compares the flow curves when the section 9 is shaped according to a cylindrical profile (continuous curve A) and according to a curvilinear profile (continuous curve B). These curves are superimposed on those which would be obtained in the absence of the channel 6 and which are shown in broken lines. It will be noted how in the presence of the channel 6 (continuous line curves A, B) the curvilinear form of the section 9 is essential for the purpose of obtaining low flow values.

To have an order of magnitude it can be stated that for a feed pipe of 44 mm diameter fitted with channel 6, the curvilinear section 9 may enable flows $Q_{mn}$<6 kg/hr to be obtained.

For greater clarity FIG. 3 shows a diagram which has the angle $\alpha$ in degrees on the abscissa and the flow Q of the fluid passing through the feed pipe 2 on the ordinate.

Figure 1:
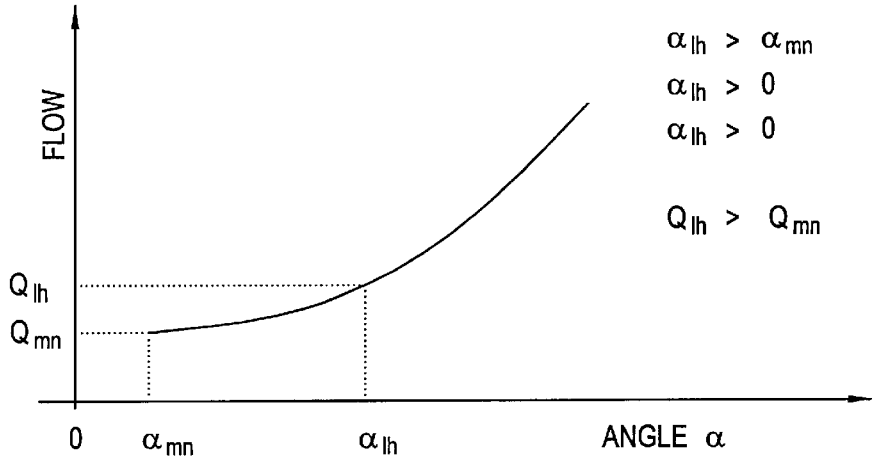
Fig. 1 (PRIOR ART)
FIGS. 1 and 2 show two examples of the operation of known throttle bodies.
Figure 2:
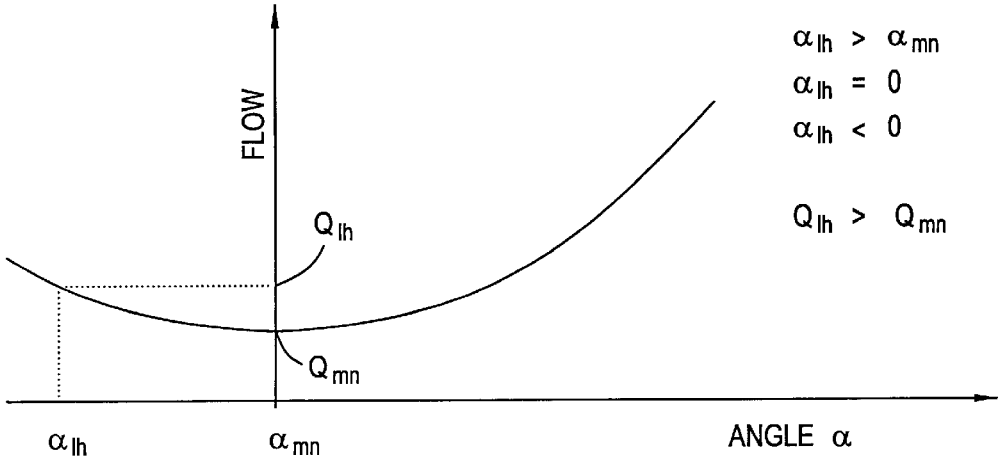
Fig. 2 (PRIOR ART)

Like FIGS. 1 and 2, FIG. 3, which shows the fluid flow curve as has been said, denotes by $\alpha_{lh}$ the angle corresponding to the position LH in which there is a flow $Q_{lh}$, whilst $\alpha_{mn}$ denotes the angle corresponding to the position MN at which there is a flow $Q_{mn}$.

The following relationship exists between the moduli of these angles:

$$\alpha_{lh}<\alpha_{mn}$$

Furthermore, with reference to the various positions shown in FIGS. 4 and 5 and assuming as positive the angles in the anti-clockwise direction defined by the arrow 4, the result is that:

$$\alpha_{lh}>0 \quad \alpha_{mn}>0$$

If, as has already been stated, $Q_{lh}$ and $Q_{mn}$ denote the flows in the position LH and the position MN respectively, there is the following relationship:

$$Q_{lh}>Q_{mn}$$

To have an order of magnitude it can be said that with a feed pipe 2 of 44 mm diameter it is possible to have a value of $Q_{lh}$ equal to 10 kg/hr and of $Q_{mn}$ equal to 4 kg/hr.

From FIG. 3 it is also clear that the device for adjusting the angle relating to the position LH (not shown in the drawings) enables the flow $Q_{lh}$ to be accurately regulated and that the value of this flow may be different with equal geometry of the pipe 2, of the diameter of the butterfly valve 3 and of the geometry of the channel 6; in fact, by acting on the above-mentioned adjustment and thus varying the value of the angle which determines the position LH, the section of passage of the air or mixture is varied; the value which the flow $Q_{lh}$ may assume varies between $Q_{im}$ and $Q_{mn}$ and complies with the following equation:

$$Q_{im}>Q_{lh}>Q_{mn}$$

where $Q_{im}$ is the flow relating to the position IM of the valve 3.

By comparing FIG. 3 with FIGS. 1 and 2 already discussed above and showing the most common embodiments of the prior art, it may be noted that the throttle body 1 produced according to the specifications of FIG. 3 has a flow curve that is completely different from those relating to the known devices.

In fact, in the case of the throttle body 1 to which the invention relates and which is shown in FIGS. 3, 4 and 5, the butterfly valve 3 is subjected to the action of a spring or of a group of springs (not shown in the accompanying drawings) which all act in the same direction of rotation.

Figure 7:
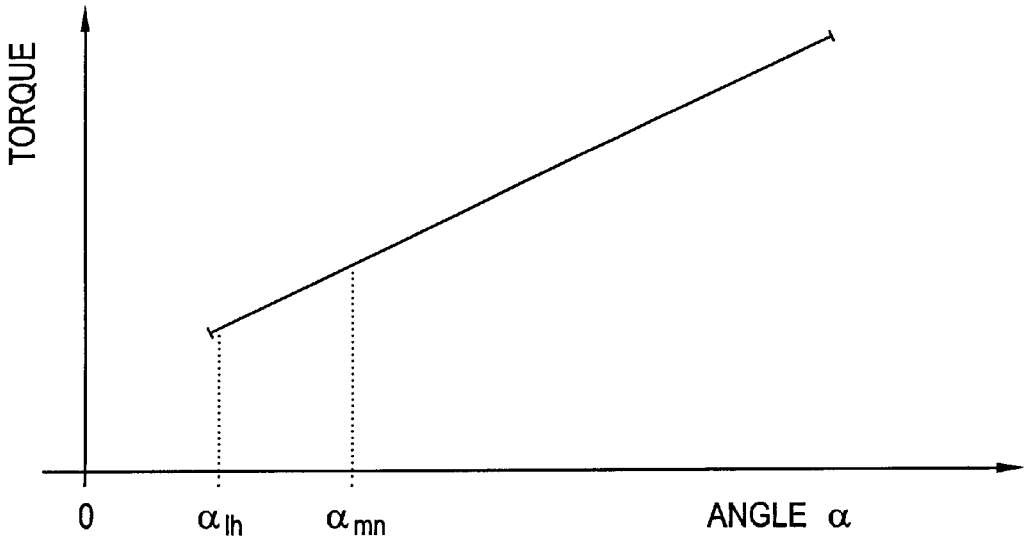
FIG. 7 shows the elastic characteristic of the spring which acts on the butterfly valve.

The elastic characteristic of this spring is shown in FIG. 7.

By using one or more springs of the same direction, the problems relating to the control of the operating device suitable for moving the butterfly valve 3 during the transient phases of passage from one state to another are solved in a simple and effective manner. As has been said, this spring has the task of pushing the butterfly valve 3 into the position LH when there is a breakdown of the actuator or no supply, a condition in which the said actuator is no longer capable of controlling the position of the valve 3.

We claim:

1. A motorized throttle body suitable for being fitted along an intake manifold of an internal combustion engine, said throttle body comprising: a feed pipe; a butterfly valve housed in a movable manner inside said feed pipe so as to define between its internal wall and an external edge of said butterfly valve a plurality of states of supply of a comburent fluid or of a comburent fluid/fuel mixture; an operating device suitable for selectively moving said butterfly valve; at least one channel provided on said internal wall, a base of which defines together with said external edge of said butterfly valve at least one limp-home flow; and provided on said internal wall, adjacent to said at least one channel, a base of said curvilinear section defining together with said external edge of said butterfly valve at least one idling flow.

2. The throttle body as claimed in claim 1, in which said butterfly valve is subjected to the action of at least one spring that causes said butterfly valve to always rotate in a same direction of rotation.

3. The throttle body as claimed in claim 2, in which said at least one spring acts so as to keep the butterfly valve in a position that establishes the limp-home flow when said operating device suitable for selectively moving said butterfly valve is not functioning or there is no current supply, and in which said at least one spring is stressed by said operating device when it is functioning correctly.

4. The throttle body as claimed in claim 1, in which the limp-home flow is adjustable by an adjusting screw.

* * * * *